US008032049B2

(12) United States Patent
Aratachi et al.

(10) Patent No.: US 8,032,049 B2
(45) Date of Patent: Oct. 4, 2011

(54) IMAGE FORMING DEVICE WITH DUCT

(75) Inventors: Tomitake Aratachi, Toyokawa (JP); Yoshito Takakuwa, Aisai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 128 days.

(21) Appl. No.: 12/392,129

(22) Filed: Feb. 25, 2009

(65) Prior Publication Data

US 2009/0220271 A1 Sep. 3, 2009

(30) Foreign Application Priority Data

Feb. 29, 2008 (JP) ..... 2008-049370
Feb. 29, 2008 (JP) ..... 2008-049375

(51) Int. Cl.
*G03G 21/20* (2006.01)

(52) U.S. Cl. ..... 399/92

(58) Field of Classification Search ..... 399/92, 399/93, 98, 99, 122, 405
See application file for complete search history.

(56) References Cited

U.S. PATENT DOCUMENTS

| | | | | |
|---|---|---|---|---|
| 7,031,632 | B2 * | 4/2006 | Deguchi et al. | 399/92 |
| 7,415,219 | B2 * | 8/2008 | Kawamata | 399/92 |

FOREIGN PATENT DOCUMENTS

| | | | |
|---|---|---|---|
| JP | 59033482 A | * | 2/1984 |
| JP | 61-193159 | | 8/1986 |
| JP | 05-024711 | | 2/1993 |
| JP | 05-134580 | | 5/1993 |
| JP | 07-089637 | | 4/1995 |
| JP | 07-172652 | | 7/1995 |
| JP | 09-281843 | | 10/1997 |
| JP | 11125983 A | * | 5/1999 |
| JP | 2000-056643 | | 2/2000 |
| JP | 2001005367 A | * | 1/2001 |
| JP | 2003-226446 | | 8/2003 |
| JP | 2005301165 A | * | 10/2005 |

OTHER PUBLICATIONS

Notification of Reasons for Refusal for Japanese Patent Application No. 2008-049370 mailed on Mar. 2, 2010.

* cited by examiner

*Primary Examiner* — Robert Beatty
(74) *Attorney, Agent, or Firm* — Banner & Witcoff, Ltd.

(57) ABSTRACT

An image forming device is provided to be able to make efficient use of an internal space while improving the detection accuracy, with which a detected body is detected. The image forming device according to the invention comprises a housing, a duct, through which an air in the housing is caused to flow, a detection portion arranged outside the duct to be displaced according to the presence of, or movement of a detected body, an operating portion that can be displaced in the duct, a detection element arranged in the duct to detect displacement of the operating portion, and a transmission portion that transmits displacement of the detection portion to the operating portion through an opening formed on the duct.

16 Claims, 13 Drawing Sheets

IMAGE FORMING DEVICE WITH DUCT

CROSS-REFERENCE TO RELATED APPLICATIONS

This application claims the benefit of priority from the prior Japanese Patent Application No. 2008-049370 and the prior Japanese Patent Application No. 2008-049375, filed Feb. 29, 2008, the contents of which are incorporated herein by reference.

BACKGROUND

JP-A-2003-226446 discloses a conventional image forming device. The image forming device comprises a housing, a duct, through which an air in the housing is caused to flow, and a detection element arranged in the duct to detect the presence of a detected body.

More specifically, the image forming device comprises conveyance means that conveys a recording sheet along a conveyance path and discharges the recording sheet outside the housing, and an image forming unit that forms an image on a recording sheet midway on the conveyance path.

The duct is arranged this side of the image forming unit on the conveyance path to comprise an intake duct arranged on one surface side of a recording sheet conveyed along the conveyance path, a guide that abuts against the other surface of the recording sheet conveyed along the conveyance path to guide the recording sheet, and an exhaust duct arranged on the other surface of the recording sheet conveyed along the conveyance path. An air in the housing is sucked through an intake hole into the intake duct to be guided toward the exhaust duct, and an air guided from the intake duct is discharged through an exhaust hole from the exhaust duct.

The detection element is an optical element provided in the intake duct to comprise a light emitting diode that emits light toward the conveyance path and a photoreceptor that receives a reflected light in the case where light emitted from the light emitting diode strikes against a detected body present on the conveyance path. The detection element detects the presence of a recording sheet as an example of a detected body between the intake duct and the exhaust duct, that is, this side of the image forming unit on the conveyance path.

With the conventional image forming device constructed in this manner, when a recording sheet conveyed along the conveyance path passes between the intake duct and the exhaust duct, an air guided to the exhaust duct from the intake duct pushes a recording sheet against the guide. Therefore, an interval between the detection element and a recording sheet is hard to vary. Also, with the image forming device, an air flowing in the intake duct readily removes foreign matters, such as paper powder, etc., adhering to the detection element.

With the image forming device, since the detection element is exposed to an air flowing in the intake duct, it is possible to restrict temperature rise of the detection element, thus enabling surely demonstrating the detecting performance of the detection element. Consequently, it is possible to improve the detection accuracy, with which a detected body is detected.

SUMMARY OF THE INVENTION

An image forming device according to the invention comprises a housing, a duct, through which an air in the housing is caused to flow, a detection portion arranged outside the duct to be displaced according to the presence of, or movement of a detected body, an operating portion that can be displaced in the duct, a detection element arranged in the duct to detect displacement of the operating portion, and a transmission portion that transmits displacement of the detection portion to the operating portion through an opening formed on the duct.

DETAILED DESCRIPTION

With the conventional image forming device, there is a need of putting the positional relationship between a recording sheet as an example of a detected body and a detection element in an access state and providing a duct so that the detection element is positioned therein. Therefore, other constituent members that must be essentially arranged around a detected body and a detection element are required to keep away therefrom, so that setting of a layout is decreased in freedom. Therefore, it is not possible in the conventional image forming device to make efficient use of an internal space.

The invention has been thought of in view of the situation in the related art and has its object to provide an image forming device capable of making efficient use of an internal space while improving that accuracy, with which a detected body is detected.

An embodiment, in which the invention is embodied in an electrographic type image forming device, that is, a so-called laser printer, will be described below with reference to the drawings.

1. Construction of Laser Printer

Figure 1:
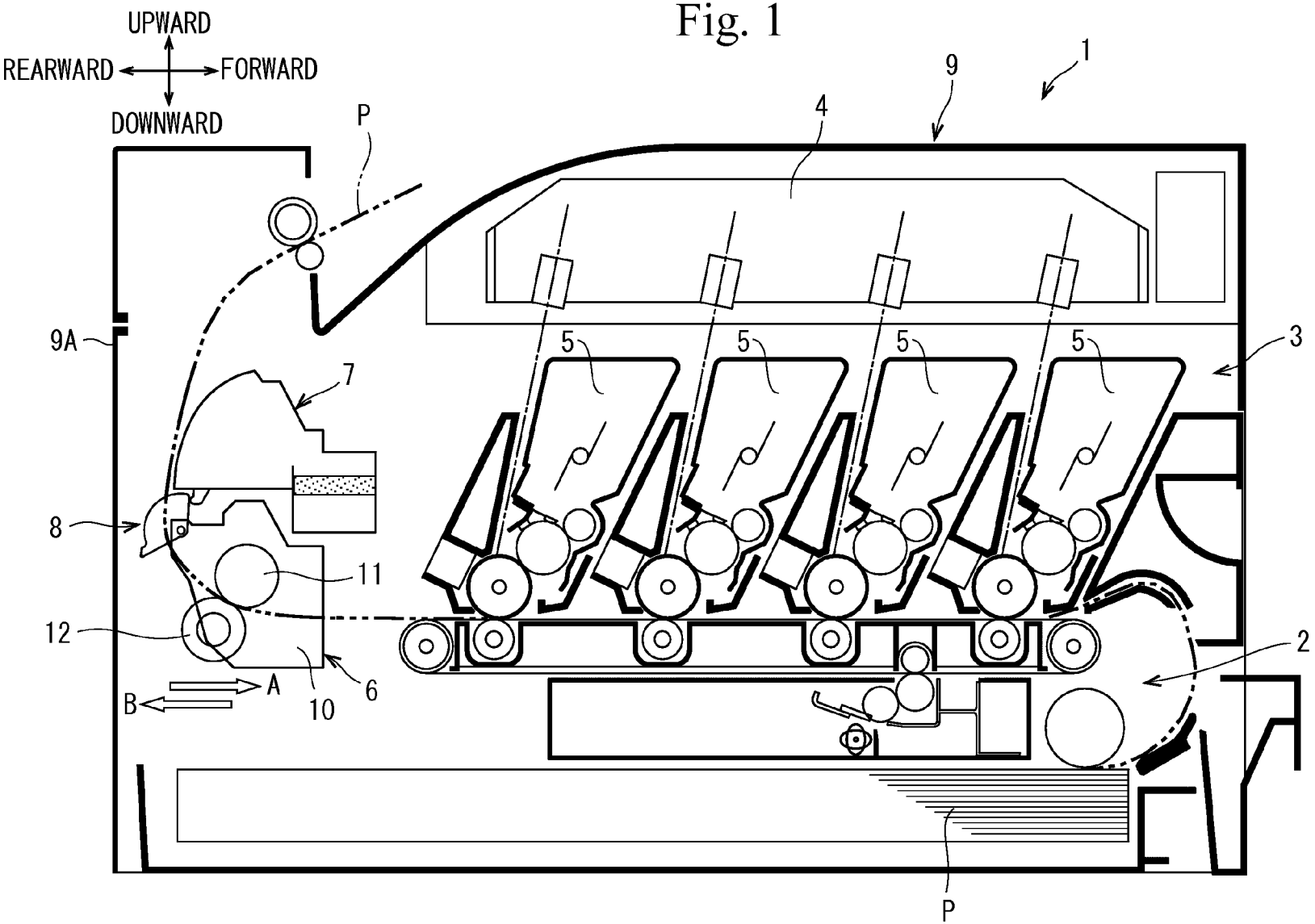
FIG. 1 is a schematic view showing an image forming device according to an embodiment.

As shown in FIG. 1, a laser printer 1 according to the embodiment is mounted with an upper side of a sheet surface being upward in a gravitational direction and normally used with a right side of the sheet surface being forward. Here, in FIG. 1, a longitudinal direction and a vertical direction are prescribed in a manner shown in the figure, this side on the sheet surface is prescribed to be a right side, and that side on the sheet surface is prescribed to be a left side. Respective longitudinal, left and right, and vertical directions shown in FIGS. 2 to 11 are all depicted to correspond to respective directions prescribed in FIG. 1.

As shown in FIG. 1, a laser printer 1 comprises a housing 9 in the form of a substantially rectangular parallelepiped, conveyance means 2, an image forming unit 3, and a fixing unit 6. Also, while described later in detail, the laser printer 1 comprises a duct 7 and a sensor 8. An explanation will be given to the construction and the image forming operation of the conveyance means 2, the image forming unit 3, and the fixing unit 6, and then a detailed explanation will be given to the duct 7 and the sensor 8.

1.1 Conveyance Means

The conveyance means 2 serves to convey recording sheets P, such as sheets, OHP sheets, or the like stored in a lower region of the housing 9 in a conveyance path indicated by two-dot chain lines in FIG. 1 to discharge the same onto an upper surface outside the housing 9. The conveyance means 2 comprises pickup rollers, separation pads, conveyance belts, discharge rollers, or the like, a construction of which is known and so an explanation of which is omitted.

1.2 Image Forming Unit

The image forming unit 3 serves to transfer a developer to a recording sheet P conveyed by the conveyance means 2 and the embodiment adopts an image forming method of an electrographic type. The image forming unit 3 includes a scanner section 4 arranged in an upper region in the housing and four development cartridges 5 arranged in series centrally in the housing 9 in a conveyance direction of a recording sheet P. The respective development cartridges 5, respectively, correspond to developers (toner) of four colors composed of cyan, Magenta, yellow, and black, and enable color printing. Since the scanner section 4, the development cartridges 5, etc., which constitute the image forming unit 3, are known in structure, an explanation therefor is omitted. Also, the image forming apparatus according to the invention is not limited to a laser printer but applicable to image forming apparatuses, in which various image forming methods are adopted.

1.3 Fixing Unit

The fixing unit 6 serves to heat and press a recording sheet P, to which a developer is transferred, to fix the developer to the recording sheet P and is arranged rearwardly of the image forming unit 3 in the housing 9. As shown, in enlarged scale, in FIG. 2, the fixing unit 6 is constructed to include a fixing unit frame member 10, a heating roller 11, a pressing roller 12, etc.

Figure 3:
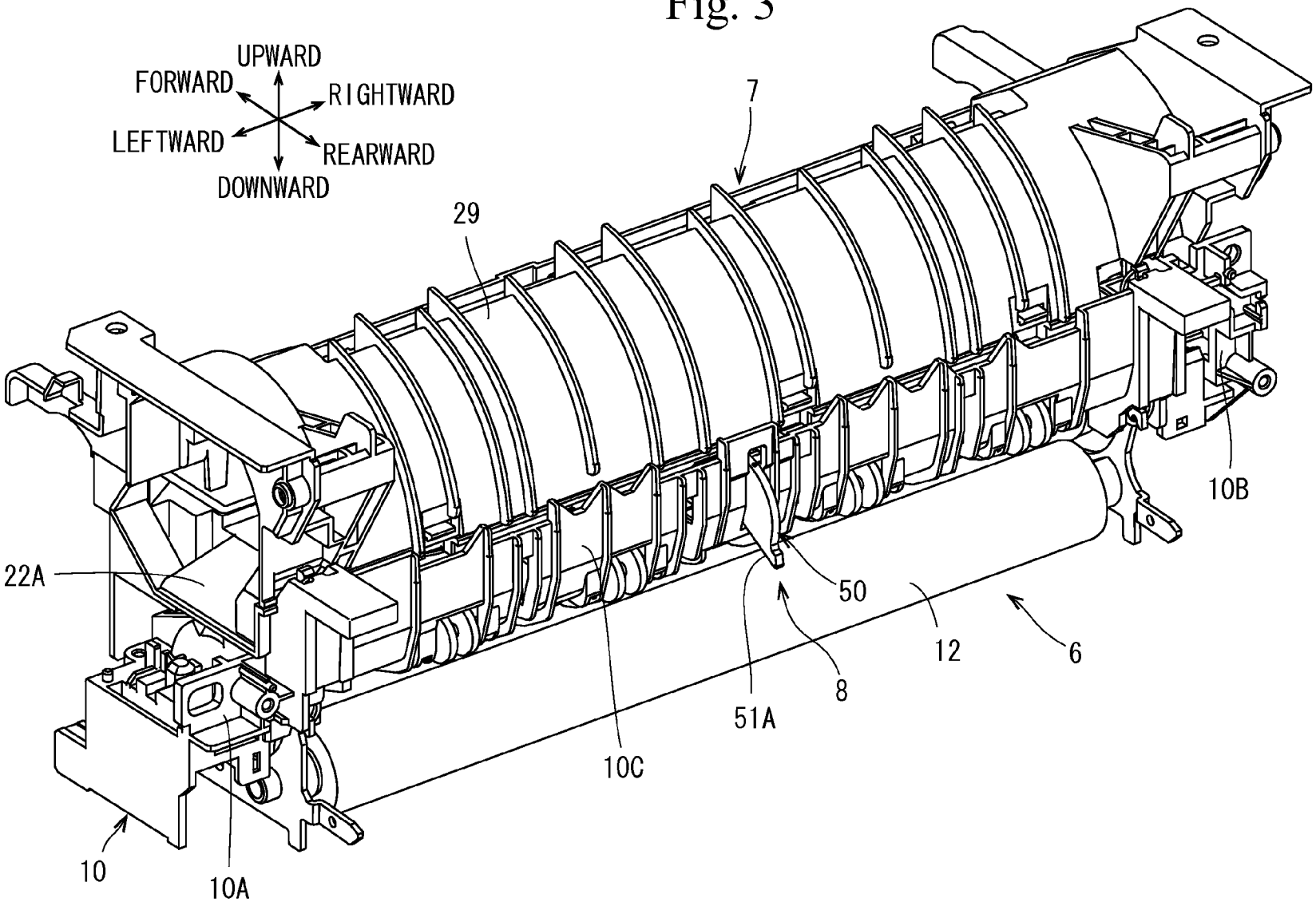
FIG. 3 is related to the image forming device according to the embodiment and a perspective view showing the fixing unit and the duct.

As shown in FIG. 3, the fixing unit frame member 10 is constructed to include a pair of left and right side frames 10A, 10B and a main frame 10C extending in a left and right direction to connect the both side frames 10A, 10B. A back surface of the main frame 10C is shaped to be curved upward along the conveyance path of a recording sheet P. A trapezoidal portion 10D is provided on an upper surface of the main frame 10C. The trapezoidal portion 10D is shaped so that an upper wall surface of the main frame 10C projects upward in a trapezoidal manner. The trapezoidal portion 10D corresponds to moving means described later.

As indicated by arrow lines A, B in FIG. 1, the fixing unit 6 is provided detachably on a fixing unit support frame (not shown) fixed rearwardly of an inner wall surface of the housing 9. Specifically, in mounting the fixing unit 6 in the housing 9, when the fixing unit 6 is slid forward from rearwardly of the housing 9 as indicated by an arrow A, the side frames 10A, 10B are fitted onto a fixing unit support frame (not shown) (a direction indicated by the arrow A is referred below to as "mount direction A"). On the other hand, in dismounting the fixing unit 6 from the housing 9, when the fixing unit 6 is slid from the housing 9 as indicated by an arrow B, the side frames 10A, 10B are not fitted onto a fixing unit support frame (not shown) (a direction indicated by the arrow B is referred below to as "dismount direction B"). In addition, mounting and dismounting of the fixing unit 6 are not obstructed by opening a rear cover 9A provided on a back surface of the housing 9. Also, as shown in FIGS. 1 to 3, the duct 7 fixed above the fixing unit 6 does not obstruct mounting and dismounting of the fixing unit 6 described later.

Figure 2:
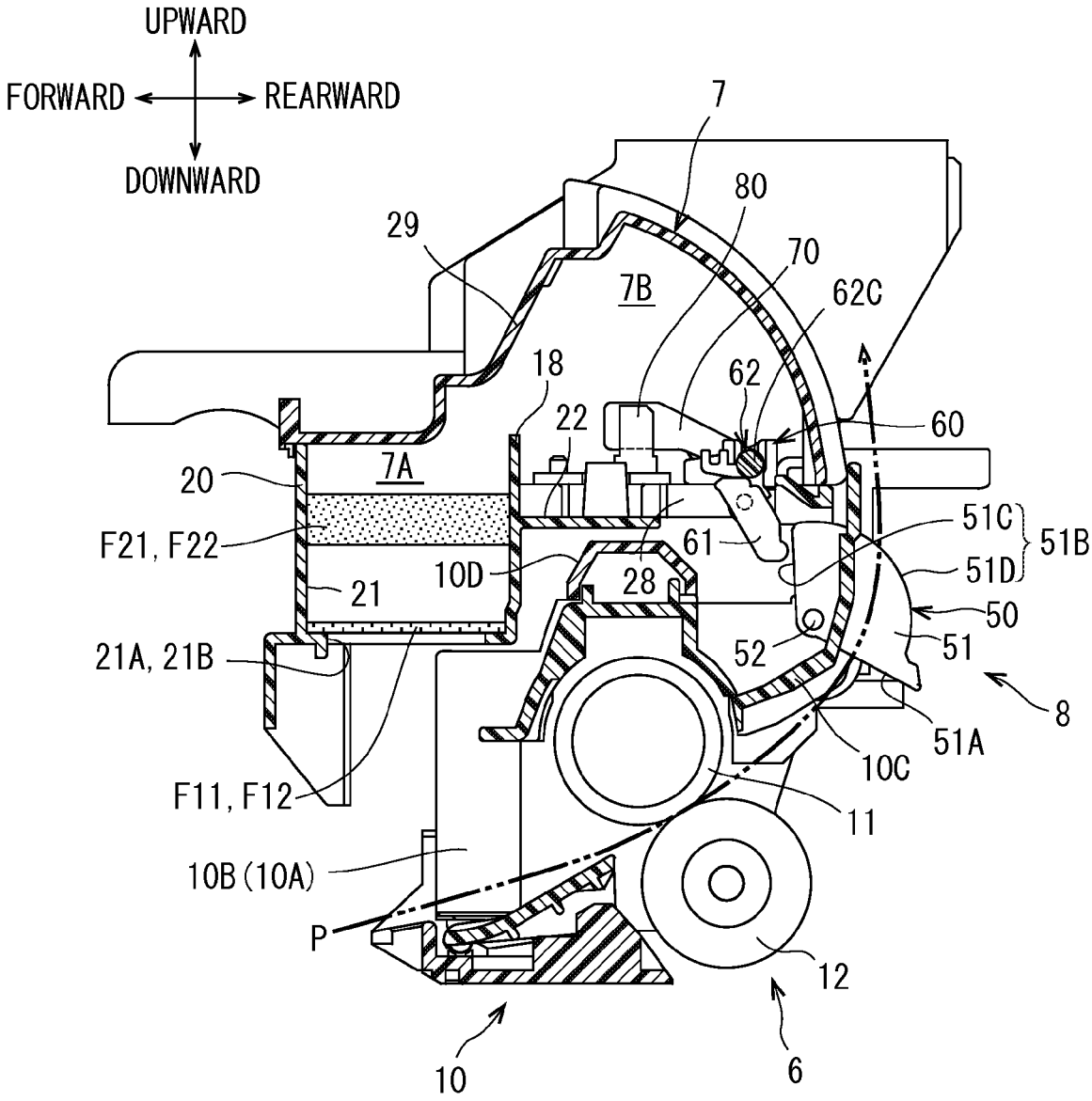
FIG. 2 is related to the image forming device according to the embodiment and an enlarged, cross sectional view showing an essential part including a fixing unit and a duct.

As shown in FIGS. 1 and 2, the heating roller 11 is a cylindrical-shaped body of revolution arranged on an image formed surface of a recording sheet P. The heating roller 11 is heated by a halogen lamp heater (not shown) arranged in a hollow portion and rotationally driven in a direction along the conveyance path by drive means (not shown) provided with a motor. The heating roller 11 is of a known configuration comprising a metallic, cylindrical-shaped core, a cylindrical-shaped elastic member fixed to an outer periphery of the core, and a releasing layer formed on a surface of the elastic member, and so an explanation therefor is omitted.

As shown in FIGS. 1 to 3, the pressing roller 12 is a columnar body of revolution provided in a manner to face the heating roller 11 on an opposite side to an image formed surface of a recording sheet P, that is, in a manner to be pushed against the heating roller 11 from under. The pressing roller 12 is rotatably supported at both ends thereof on the side frames 10A, 10B. Therefore, when the heating roller 11 rotates, the pressing roller 12 is drivenly rotated in a reverse direction to the heating roller 11. The pressing roller 12 is of a known configuration, in which a cylindrical member made of a heat resisting rubber is made integral with an outer periphery of a metallic support shaft, and so an explanation therefor is omitted.

1.4 Outline of Image Forming Operation

With the laser printer 1 constructed in this manner, when an image forming operation begins as shown in FIG. 1, a recording sheet P is conveyed to the image forming unit 3 by the conveyance means 2. In the image forming unit 3, surfaces of photoreceptors of the respective development cartridges 5 are evenly positive-charged by a charging device on the basis of image forming data and exposed by laser beams irradiated from the scanner section 4 with the result that an electrostatic, latent image is formed on the surfaces of the photoreceptors. Subsequently, developers as positive-charged are supplied to the electrostatic, latent image. Thereby, the electrostatic, latent image on the photoreceptors is made a visible image as a developer image. Thereafter, the developer image is transferred to the recording sheet P and the recording sheet P is conveyed to the fixing unit 6. In the fixing unit 6, the developers are heated and pressed by the heating roller 11 and the pressing roller 12 to melt and fixed to the recording sheet P. Thereafter, the recording sheet P is discharged onto the upper surface outside the housing 9.

The laser printer 1 comprises the duct 7, through which an air in the housing 9 is sucked and guided outside the housing 9 to be exhausted. Also, with the laser printer 1, there is infrequently caused a disadvantage that in the fixing unit 6, a recording sheet P is stopped on the conveyance path, or a developer as melted adheres to cause a recording sheet P to be wound round the heating roller 11. Therefore, the laser printer 1 comprises the sensor 8 provided rearwardly of the fixing unit 6 to detect the presence of a recording sheet P and it is determined on the basis of results of detection of the sensor 8 and other control information whether the disadvantage described above is caused. In addition, while the sensor 8 detects the presence of a recording sheet P in the embodiment, it is not limitative but may detect passage (movement) of a recording sheet P. A detailed explanation will be given below to the duct 7 and the sensor 8.

2. Duct

Figure 4:
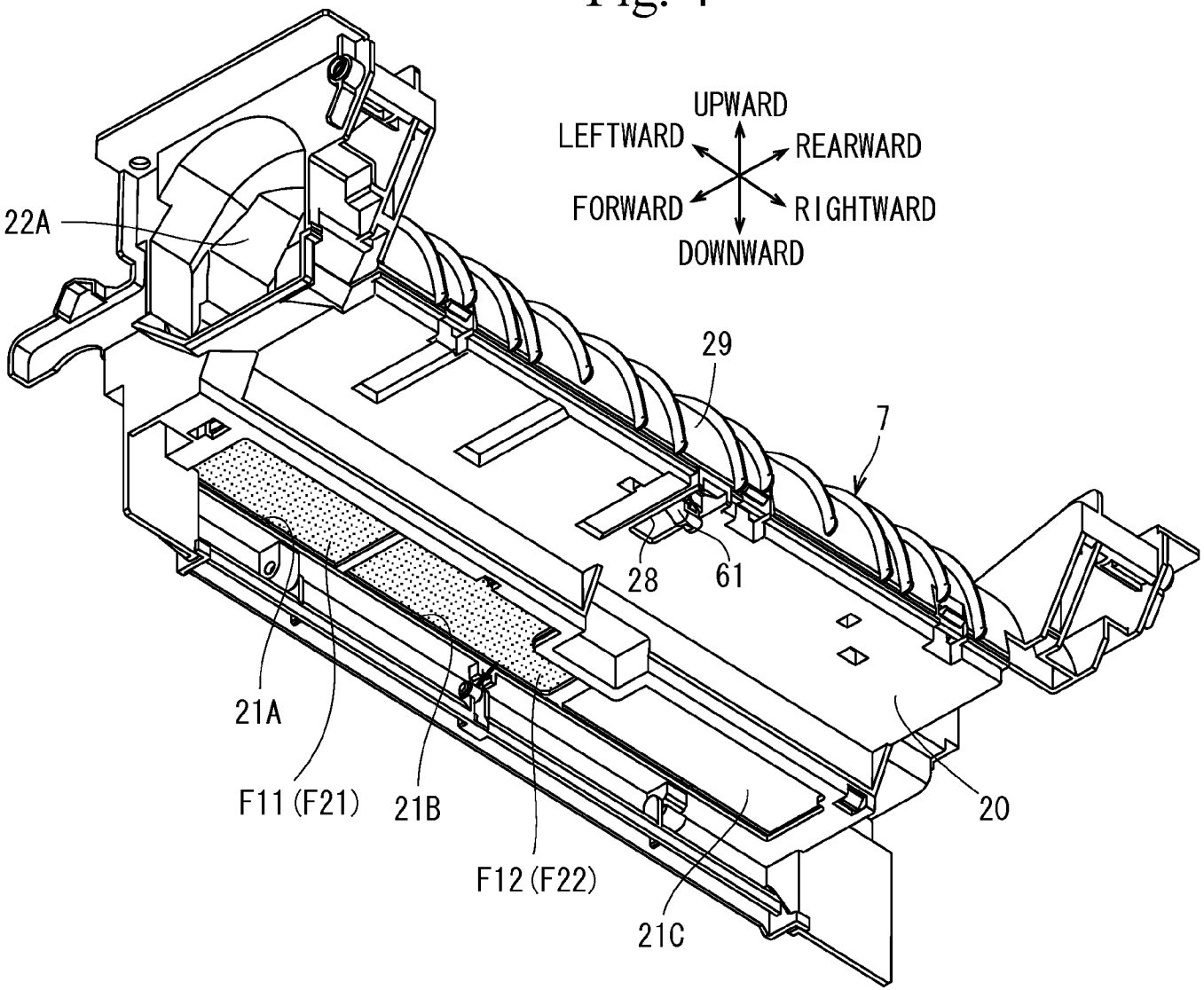
FIG. 4 is related to the image forming device according to the embodiment and a perspective view showing the duct.

As shown in FIG. 1, the duct 7 is fixed rearwardly of the image forming unit 3 and upwardly of the fixing unit 6. As shown in FIGS. 2 to 4, the duct 7 is constructed to include a bottom wall portion 20 in the form of a stepped plate to extend longitudinally in a left and right direction, and an upper wall portion 29 having an inverted "U" shaped cross section and covering the bottom wall portion 20 from above to form an internal space being lengthy in the left and right direction.

Figure 5:
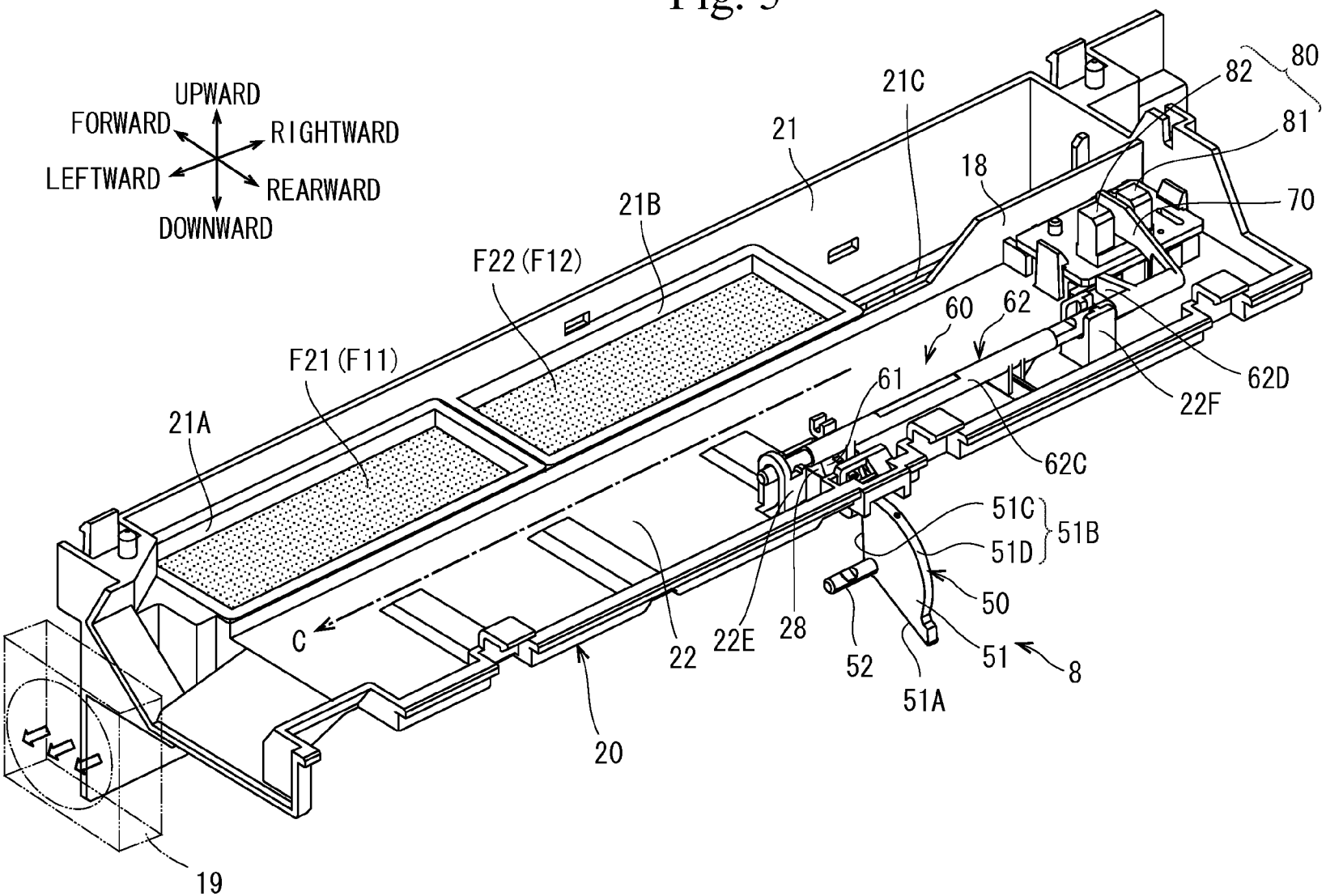
FIG. 5 is related to the image forming device according to the embodiment and a perspective view showing a detection portion, a transmission portion, an operating portion, and a bottom wall portion that constitutes a detection element and a duct.
Figure 6:
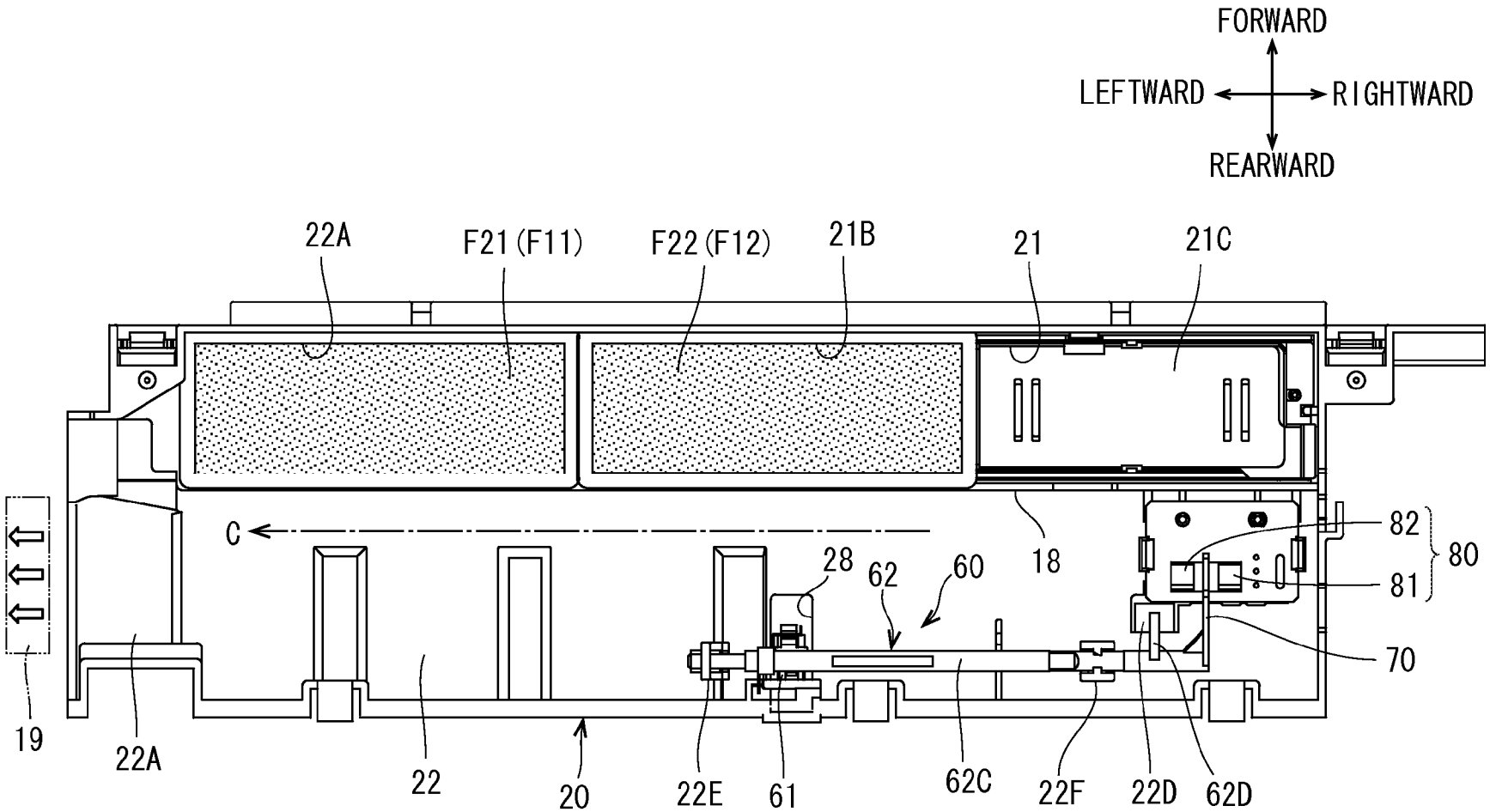
FIG. 6 is related to the image forming device according to the embodiment and a plan view showing the transmission portion, the operating portion, and the bottom wall portion that constitutes the detection element and the duct.

As shown in FIGS. 5 and 6, the bottom wall portion 20 is compartmented into a first inner peripheral surface 21 extending on a forward side longitudinally in the left and right direction and a second inner peripheral surface 22 adjacent to and rearwardly of the first inner peripheral surface 21 to extend in the left and right direction.

Intake portions 21A, 21B in the form of a rectangular-shaped hole are provided centrally of and on the left of the first inner peripheral surface 21 to extend therethrough. The intake portions 21A, 21B permit an air in the housing 9 to be sucked therethrough. Filters F11, F12 are mounted below the intake portions 21A, 21B and filters F21, F22 are mounted above the intake portions 21A, 21B. The filters F11, F12 comprise a so-called toner filter to serve to filter foreign matters (referred below simply to as "foreign matters") such as dust, paper powder, developers, etc. generated from a recording sheet P, the image forming unit 3, or the like to prevent the same from entering into the duct 7. The filters F21, F22 comprise a so-called ozone filter to serve to remove ozone generated by a charging device of the image forming unit 3, or the like to prevent the same from entering into the duct 7. In addition, the right side of the first inner peripheral surface 21 is closed by a bottom surface portion 21C.

As shown in FIG. 2, a space surrounded by the first inner peripheral surface 21 and the upper wall portion 29 defines a first chamber 7A, in which the intake portions 21A, 21B are positioned. Both left and right sides of the first chamber 7A is closed by the first inner peripheral surface 21 and the upper wall portion 29.

As shown in FIG. 2, the first inner peripheral surface 21 and the second inner peripheral surface 22 define a bottom surface of the duct 7, the second inner peripheral surface 22 being positioned vertically upwardly of the first inner peripheral surface 21. A space surrounded by the second inner peripheral surface 22 and the upper wall portion 29 define a second chamber 7B. Positioned in the second chamber 7B are a detection element 80, an interception member 70, and a rotating shaft 62C. The right side of the second chamber 7B is closed by the second inner peripheral surface 22 and the upper wall portion 29. On the other hand, an exhaust portion 22A, through which an air in the housing 9 is discharged outside, is defined on the left side of the second chamber 7B as shown in FIGS. 3 and 4. As shown in FIGS. 5 and 6, the exhaust portion 22A faces a ventilation fan 19 provided on the left, inner wall surface of the housing 9. An axis of rotation of the ventilation fan 19 is parallel to the left and right direction. Therefore, the ventilation fan 19 is driven by drive means (not shown) to forcedly draw an air in the second chamber 7B to the left from the right to discharge the same outside the housing 9.

As shown in FIGS. 2 and 5, a partition 18 provided protrusively upward from under like a screen is formed between the first chamber 7A and the second chamber 7B. The partition 18 extends longitudinally in the left and right direction with a clearance between it and the upper wall portion 29. The reason why the partition 18 is formed in this manner is that foreign matters are liable to undergo vertically downward precipitation/deposition. The partition 18 partitions between the first chamber 7A and the second chamber 7B while permitting ventilation therebetween whereby it corresponds to a prevention member that prevents foreign matters from moving to the second chamber 7B from the first chamber 7A. In addition, the reason why the partition 18 is higher at a right end thereof than the remaining portions thereof is that it is directed to surely preventing foreign matters from moving to the detection element 80, the interception member 70, etc., which will be described later and are positioned in the vicinity thereof.

As shown in FIGS. 4 and 5, an opening 28 in the form of a rectangle being lengthy in a longitudinal direction is provided through and centrally of the second inner peripheral surface 22 in the left and right direction. Also, the opening 28 is arranged rearwardly away from the intake portions 21A, 21B. In addition, a connection member 60 described later extends through the opening 28.

In the duct 7 structured in this manner, when the ventilation fan 19 is rotationally driven, an air in the housing 9 is drawn through the first chamber 7A into the second chamber 7B from the intake portions 21A, 21B. Thereafter, the air thus drawn is guided along the second chamber 7B, which extends in the left and right direction, to be discharged the same outside the housing 9 from the exhaust portion 22A. Hereupon, a direction, in which an air in the second chamber 7B is guided, is referred to as an air guiding direction C (indicated by a alternate long and short dash line in FIGS. 5 and 6). At this time, since foreign matters in the housing are filtered by the filters F11, F12 and the filters F21, F22, foreign matters are inhibited from entering into the duct 7. Also, even when foreign matters are not filtered by the filters F11, F12, F21, F22 and drawn into the first chamber 7A, a level difference between the first inner peripheral surface 21 and the second inner peripheral surface 22 and the partition 18 surely prevent the foreign matters from moving into the second chamber 7B.

3. Sensor

As shown in FIGS. 1 and 2, the sensor 8 serves to detect the presence of a recording sheet P as an example of a detected body rearwardly of the fixing unit 6 and is positioned downstream of the heating roller 11 of the fixing unit 6 on the conveyance path of a recording sheet P. As shown in FIGS. 2 to 9, the sensor 8 is constructed to include a sector-shaped swinging member 50, the detection element 80, the interception member 70, and the connection member 60. The respective constituent elements will be described below in detail.

3.1 Sector-Shaped Swinging Member

As shown in FIGS. 2 and 3, the sector-shaped swinging member 50 is provided centrally on a back surface of the fixing unit 6 in the left and right direction. As shown in an enlarged scale in FIGS. 7 and 8, the sector-shaped swinging member 50 includes a sector-shaped sector portion 51, a shaft portion 52 extending with a central axis of an arc of the sector portion 51 as an axis thereof, a detection portion 51A, and a first transmission portion 51B.

The shaft portion 52 is supported inside on a back surface of the main frame 10C of the fixing unit 6 to be rotatable about a second axis X2 (shown in FIG. 7) in parallel to the heating roller 11 and the pressing roller 12. The second axis X2 is perpendicular to the mount direction A and the dismount direction B of the fixing unit 6 and the conveyance direction of a recording sheet P. The sector portion 51 is put in a state, in which the arc is positioned rearwardly of the shaft portion 52.

Figure 8:
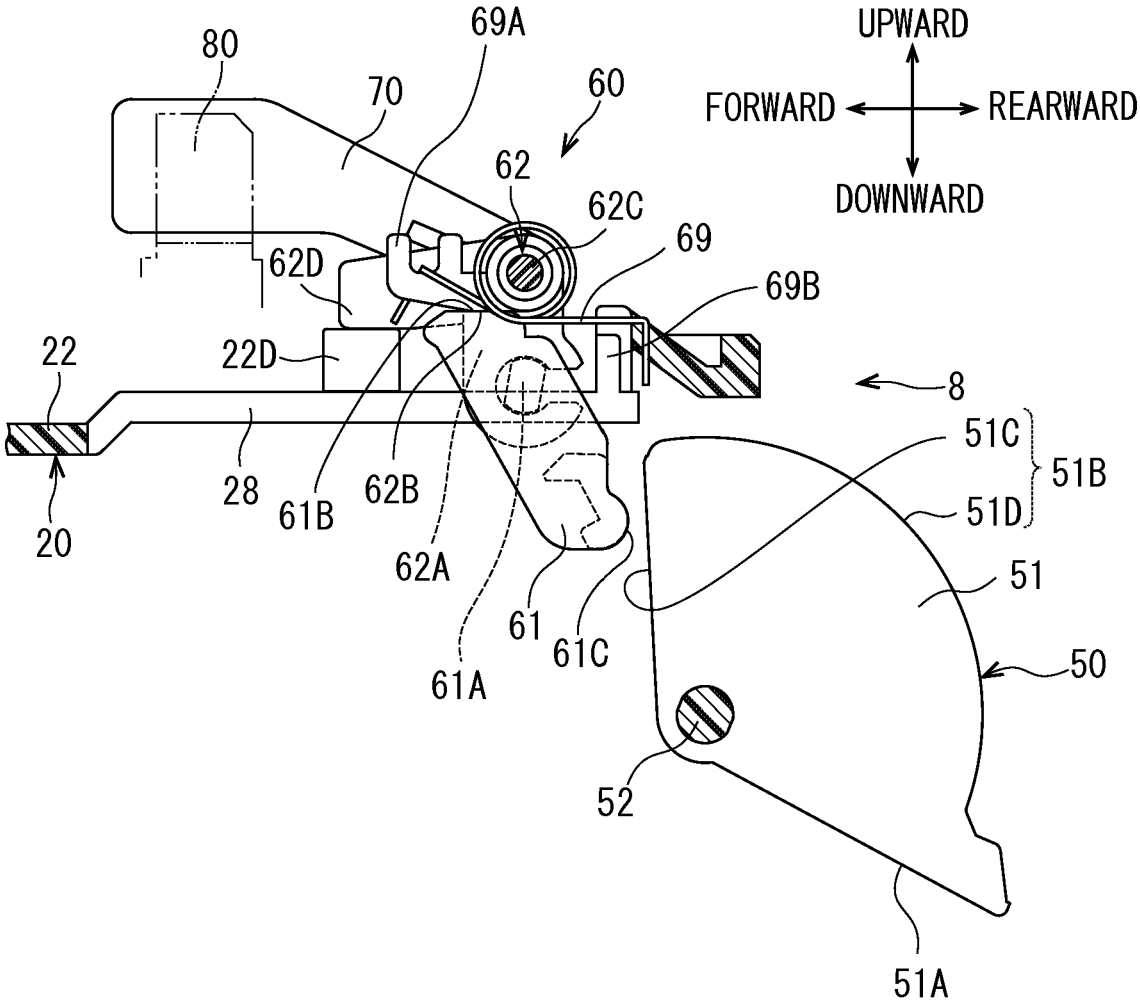
FIG. 8 is related to the image forming device according to the embodiment and an enlarged, cross sectional view showing the detection portion, the transmission portion, the operating portion, the detection element, and an opening in a state, in which a recording sheet is not detected.
Figure 9:
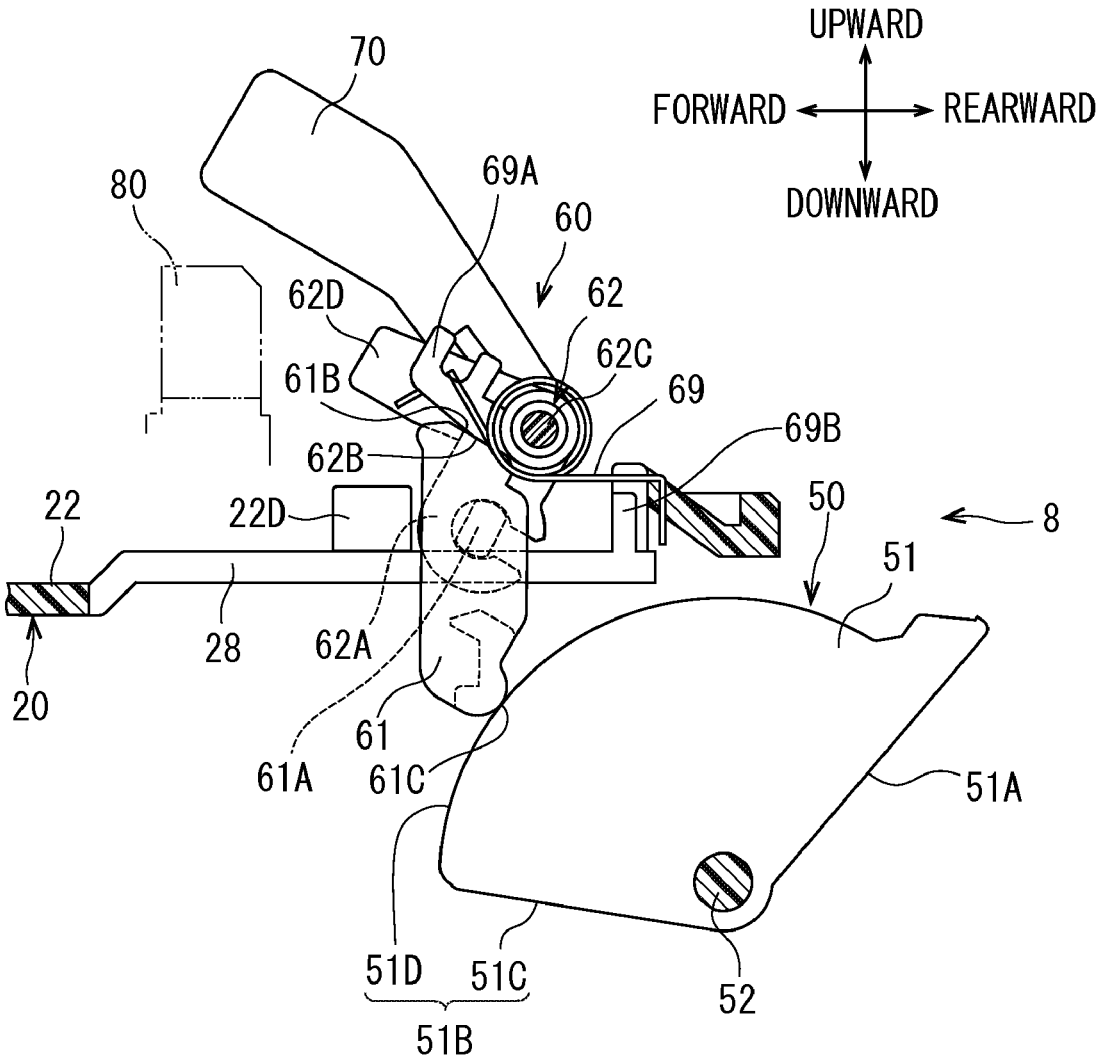
FIG. 9 is related to the image forming device according to the embodiment and a partially enlarged, cross sectional view showing the detection portion, the transmission portion, the operating portion, the detection element, and the opening in a state, in which a recording sheet is detected.

The detection portion 51A comprises a side of the sector portion 51 extending straight toward a lower end of the arc of the sector portion 51 from a side of the shaft portion 52. As shown in FIG. 2, the detection portion 51A projects rearward from the back surface side of the main frame 10C to block the conveyance path of a recording sheet P. Therefore, when a recording sheet P is conveyed downstream of the heating roller 11, the detection portion 51A contacts the recording sheet P to swing about the shaft portion 52 to be displaced upward as shown in FIG. 9. Thereafter, when the recording sheet P is conveyed further downstream to separate from the detection portion 51A, the detection portion 51A is returned to an original position by dead weight. In the embodiment, the configuration of the sector portion 51 including the detection portion 51A is determined so that the detection portion 51A is returned to the original position shown in FIG. 8 from a position shown in FIG. 9 by the dead weight of the sector portion 51.

The first transmission portion 51B is constructed to include an abutment surface 51C and a guiding surface 51D. The abutment surface 51C comprises a side of the sector portion 51 extending straight toward an upper end of the arc of the sector portion 51 from the side of the shaft portion 52 and is positioned on a side toward a rear end of the opening 28 of the duct 7 positioned above the fixing unit 6. The guiding surface 51D comprises an arcuate side contiguous to an upper end of the abutment surface 51C to extend from a second axis X2 with the same radius. As shown in FIG. 9, when the detection portion 51A swings upward, the first transmission portion 51B swings about the shaft portion 52 (the second axis X2) together with the detection portion 51A to be displaced forward.

3.2 Detection Element

As shown in FIGS. 5 and 6, the detection element 80 is arranged at a right end of the second inner peripheral surface 22 in the second chamber 7B of the duct 7. The detection element 80 comprises a general photo-interrupter to include a light emitting diode 81 and a photodetector 82 arranged in opposition to the light emitting diode 81 to receive light irradiated from the light emitting diode 81. The detection element 80 detects the presence of a recording sheet P depending upon whether the interception member 70 as an example of an operating portion intercepts receiving of light by the photodetector 82.

3.3 Interception Member

As shown in FIGS. 5 to 8, the interception member 70 comprises a plate-shaped member arranged at the right end of the second inner peripheral surface 22 in the second chamber 7B of the duct 7. As shown elaborately in FIG. 8, a stopper 62D, described later, arranged in parallel to the interception member 70 abuts against a stopper portion 22D protrusively provided on the second inner peripheral surface 22 of the bottom wall portion 20 from above whereby the interception member 70 is ordinarily put in a state of being stopped between the light emitting diode 81 and the photodetector 82. In this case, the interception member 70 intercepts light irradiated onto the photodetector 82 from the light emitting diode 81.

As shown in FIG. 9, when the detection portion 51A is displaced, the displacement is transmitted by the first transmission portion 51B and the connection member 60 described later whereby a forward end side of the interception member 70 swings upward. When the forward end of the interception member 70 swings upward, light irradiated onto the photodetector 82 from the light emitting diode 81 is not intercepted and the photodetector 82 receives the light. The interception member 70 corresponds to an operating portion being displaceable in the duct 7.

3.4 Connection Member

As shown in FIGS. 5 to 8, the connection member 60 is constructed to include a first split body 62 having the rotating shaft 62C and a bearing portion 62A and a second transmission portion 61 as a second split body 61.

The rotating shaft 62C of the first split body 62 comprises a longitudinal, columnar shaft body being lengthy in the left and right direction and is provided in the second chamber 7B of the duct 7. The rotating shaft 62C is supported rotatably by two bearing portions 22E, 22F protrusively provided on the second inner peripheral surface 22 of the bottom wall portion 20 to be separate from each other in the left and right direction. A left end of the rotating shaft 62C is positioned above the opening 28 provided through and centrally of the second inner peripheral surface 22 in the left and right direction. On the other hand, a right end of the rotating shaft 62C is positioned at the right end of the second inner peripheral surface 22 and provided integral with the interception member 70. As shown in FIGS. 5 and 6, the rotating shaft 62C is arranged to extend downstream in the air guiding direction C from upstream therein, that is, to extend in parallel to the air guiding direction C. Here, in the embodiment, the air guiding direction C corresponds to an axial direction of the ventilation fan 19.

The rotating shaft 62C integrally includes a stopper 62D projecting forward between the interception member 70 and the bearing portion 22F on the right side. As shown in FIG. 8, the stopper 62D abuts against the stopper portion 22D to restrict one end side of the interception member 70 in a range of swinging.

As shown in FIG. 8, the bearing portion 62A is provided to project downward from the left end of the rotating shaft 62C and supports a shaft portion 61A formed at an upper end of the second transmission portion 61. The shaft portion 61A is supported to be able to swing about a first axis X1 (shown in FIG. 7) in parallel to the heating roller 11 and the pressing roller 12. The first axis X1 is perpendicular to the mount direction A and the dismount direction B of the fixing unit 6 and the conveyance direction of a recording sheet P. Also, the first axis X1 is in parallel to the second axis X2.

Figure 7:
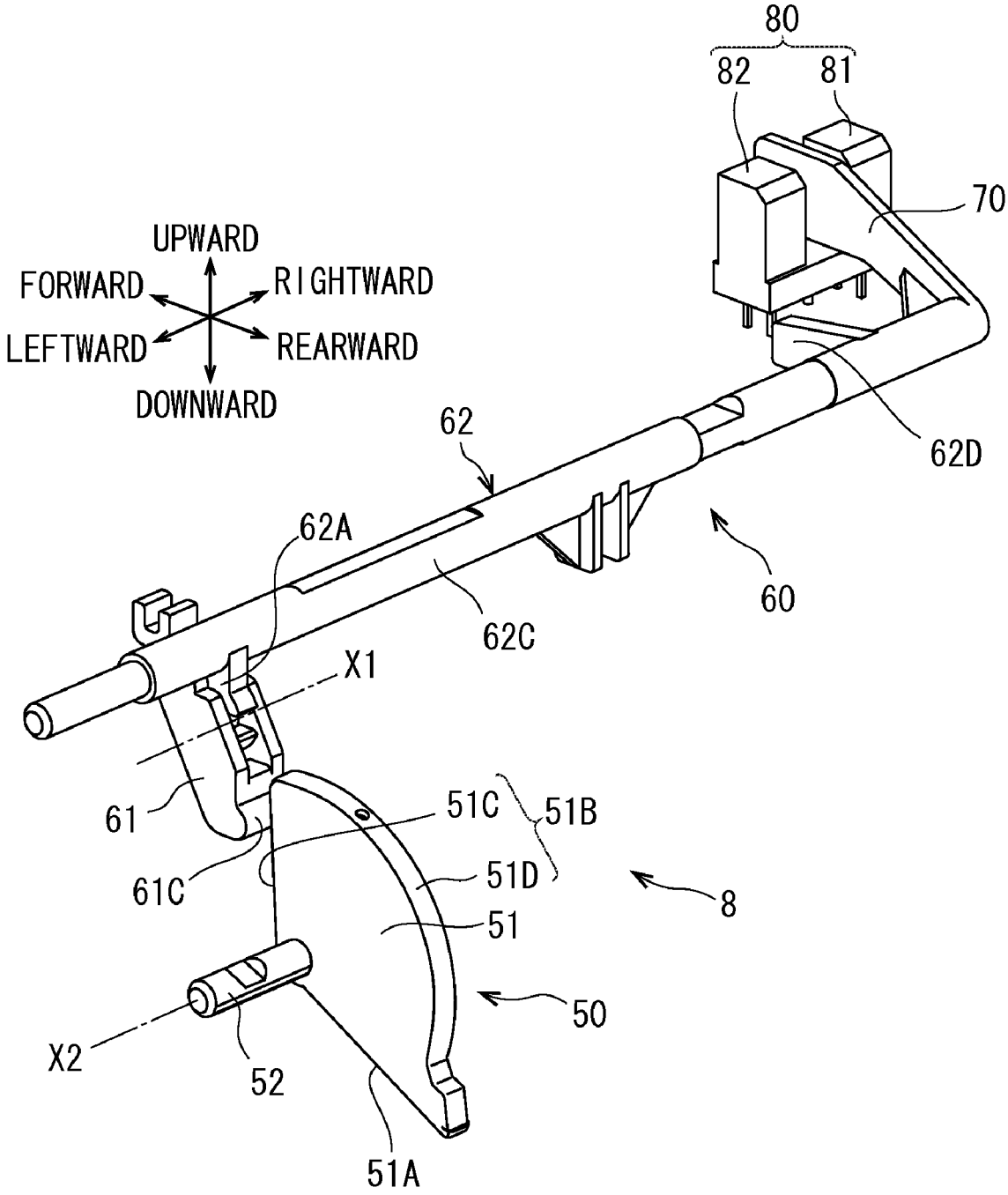
FIG. 7 is related to the image forming device according to the embodiment and a perspective view showing the detection portion, the transmission portion, the operating portion, and the detection element.

As shown elaborately in FIGS. 7 and 8, the second transmission portion 61 as a second split body is connected to the left end of the rotating shaft 62C to extend through the opening 28 to project downward.

As described above, the shaft portion 61A on an upper end of the second transmission portion 61 is supported by the bearing portion 62A to be able to swing. A lower end of the second transmission portion 61 is formed with a guided surface 61C, which is positioned forwardly of the first transmission portion 51B to project roundedly rearward. As shown in FIGS. 8 and 9, when the first transmission portion 51B swings forward, the guided surface 61C first abuts against the abutment surface 51C to be displaced forward and then abuts against the guiding surface 51D to maintain swinging of the first transmission body 62 in a predetermined posture.

Figure 10:
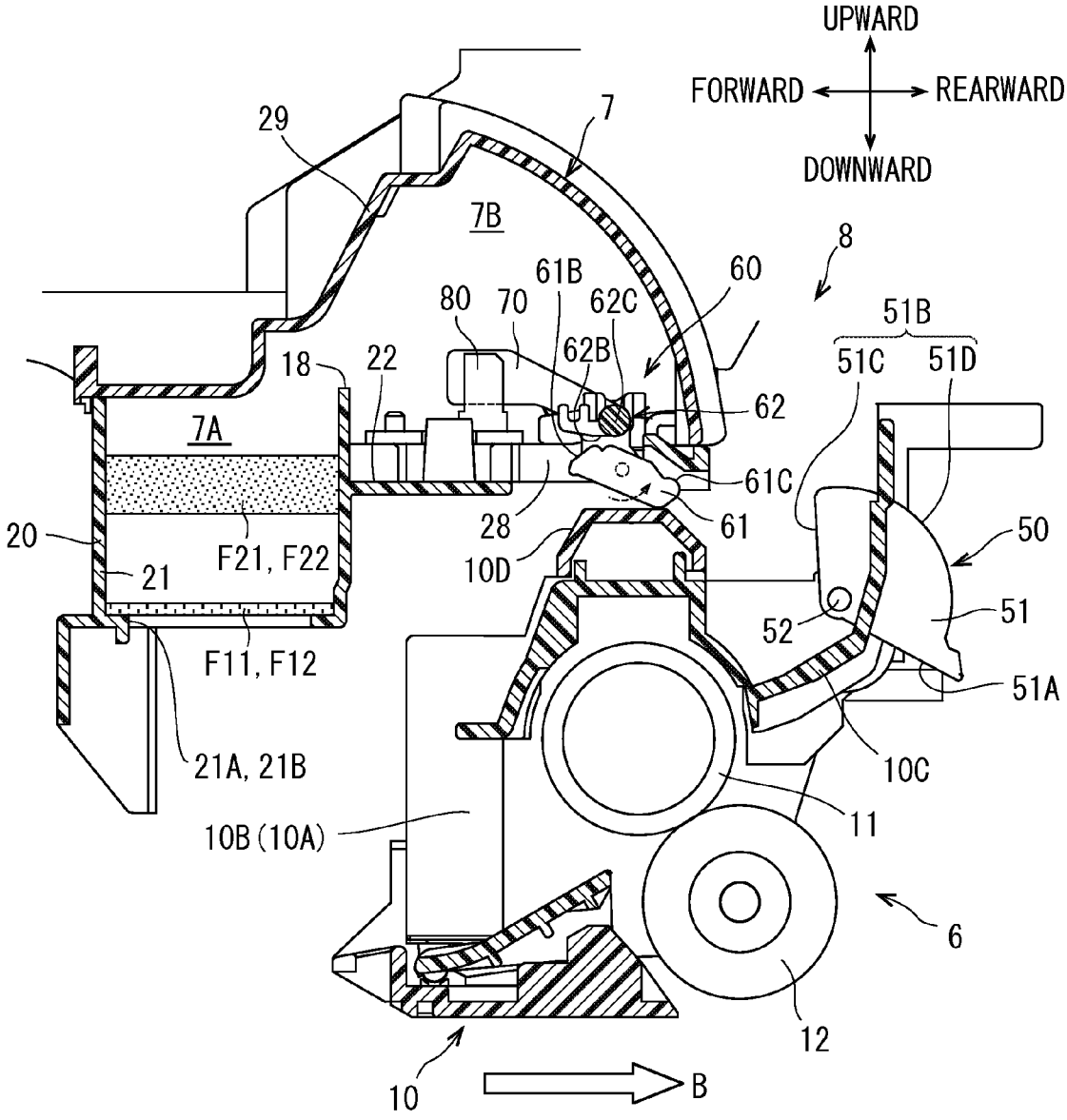
FIG. 10 is related to the image forming device according to the embodiment and an enlarged, cross sectional view showing an essential part and illustrating a motion, in which the fixing unit is removed from a housing.

As shown in FIGS. 8 and 9, a bias spring 69 is mounted to the rotating shaft 62C. One end of the bias spring 69 is latched on a latch portion 69A provided to project forward from the rotating shaft 62C and the other end of the bias spring 69 is latched on a latch portion 69B formed by cutting out a part of the bottom wall portion 20. The bias spring 69 biases the rotating shaft 62C in a direction to swing the lower end of the second transmission portion 61 rearward, that is, in a direction to swing the forward end of the interception member 70 downward. Also, ordinarily, the left end of the rotating shaft 62C and the upper end of the second transmission portion 61 are stopped with restriction surfaces 61B, 62B, which are formed forwardly of an axis of the rotating shaft 62C, abutting against each other. Therefore, as shown in FIG. 9, in the case where the lower end of the second transmission portion 61 should swing forward, the rotating shaft 62C swings together through the restriction surfaces 61B, 62B. On the other hand, while being described below in detail, as shown in FIG. 10, in the case where the lower end of the second transmission portion 61 should swing rearward, the restriction surfaces 61B, 62B separate from each other, so that the rotating shaft 62C will not swing together with the second transmission portion 61.

4. Detecting Operation

In the image forming operation of the laser printer 1, when a recording sheet P is normally conveyed rearwardly of the fixing unit 6 without the generation of a disadvantage that the recording sheet P is stopped on the conveyance path or the recording sheet P is wound round the heating roller 11, the detection portion 51A of the sensor 8 thus structured contacts the recording sheet P to be displaced upward as shown in FIG. 9. Then the first transmission portion 51B is displaced forward from a position shown in FIG. 8 to have the abutment surface 51C abutting against the guided surface 61C of the second transmission portion 61 to push the same forward. Therefore, the lower end of the second transmission portion 61 swings forward about the rotating shaft 62C, so that displacement of the detection portion 51A is transmitted to the interception member 70 at the right end of the rotating shaft 62C, thus having the forward end of the interception member 70 swinging upward. When the detection portion 51A is upwardly displaced up to a predetermined position, the guided surface 61C of the second transmission portion 61 runs on the guiding surface 51D of the sector portion 51 as shown in FIG. 9. Thereby, the interception member 70 is held in a predetermined, upper position. Consequently, a control unit (not shown) acquires results of detection that the detection element 80 has detected a displacement of the interception member 70.

Thereafter, when the recording sheet P is conveyed further downstream and does not contact the detection portion 51A, the detection portion 51A is returned to the original position shown in FIG. 8 by the dead weight of the sector portion 51. Therefore, a displacement of the detection portion 51A is transmitted to the interception member 70 through the first transmission portion 51B, the second transmission portion 61, and the rotating shaft 62C, so that the interception member 70 is returned to the original position. Consequently, the control unit (not shown) acquires results of detection that the detection element 80 has detected return of the interception member 70 to the original position.

On the other hand, in the image forming operation of the laser printer 1, when the disadvantage described above is caused, the detection portion 51A is not displaced even when a predetermined period of time has lapsed after a sensor (not shown) arranged upstream of the detection portion 51A detects passage of a recording sheet P, so that the detection element 80 does not also detect a displacement of the interception member 70. In this case, the control unit (not shown) acquires results of detection that the detection element 80 has not detected the displacement of the interception member 70

Thus with the laser printer 1, the control unit (not shown) can determine, on the basis of results of detection of the detection element 80 described above and other control information, whether there is caused a disadvantage that a recording sheet P is stopped on the conveyance path, or the recording sheet P is wound round the heating roller 11.

5. Motion of the Connection Member when the Fixing Unit is Mounted or Dismounted The fixing unit 6 is constructed to be mounted to or dismounted from the housing 9. Therefore, the connection member 60 does not prevent the fixing unit 6 from being mounted or dismounted as described later.

As shown in FIG. 10, in dismounting the fixing unit 6 from the housing 9, the trapezoidal portion 10D provided on the upper surface of the main frame 10C abuts against the lower end of the second transmission portion 61 to swing the lower end of the second transmission portion 61 rearward. In this case, since the restriction surfaces 61B, 62B described above separate from each other, the rotating shaft 62C will not swing together with the second transmission portion 61. Therefore, with the laser printer 1, a user can remove the fixing unit from the housing 9 without being obstructed by the interception member 70, the rotating shaft 62C, and the second transmission portion 61.

Figure 11:
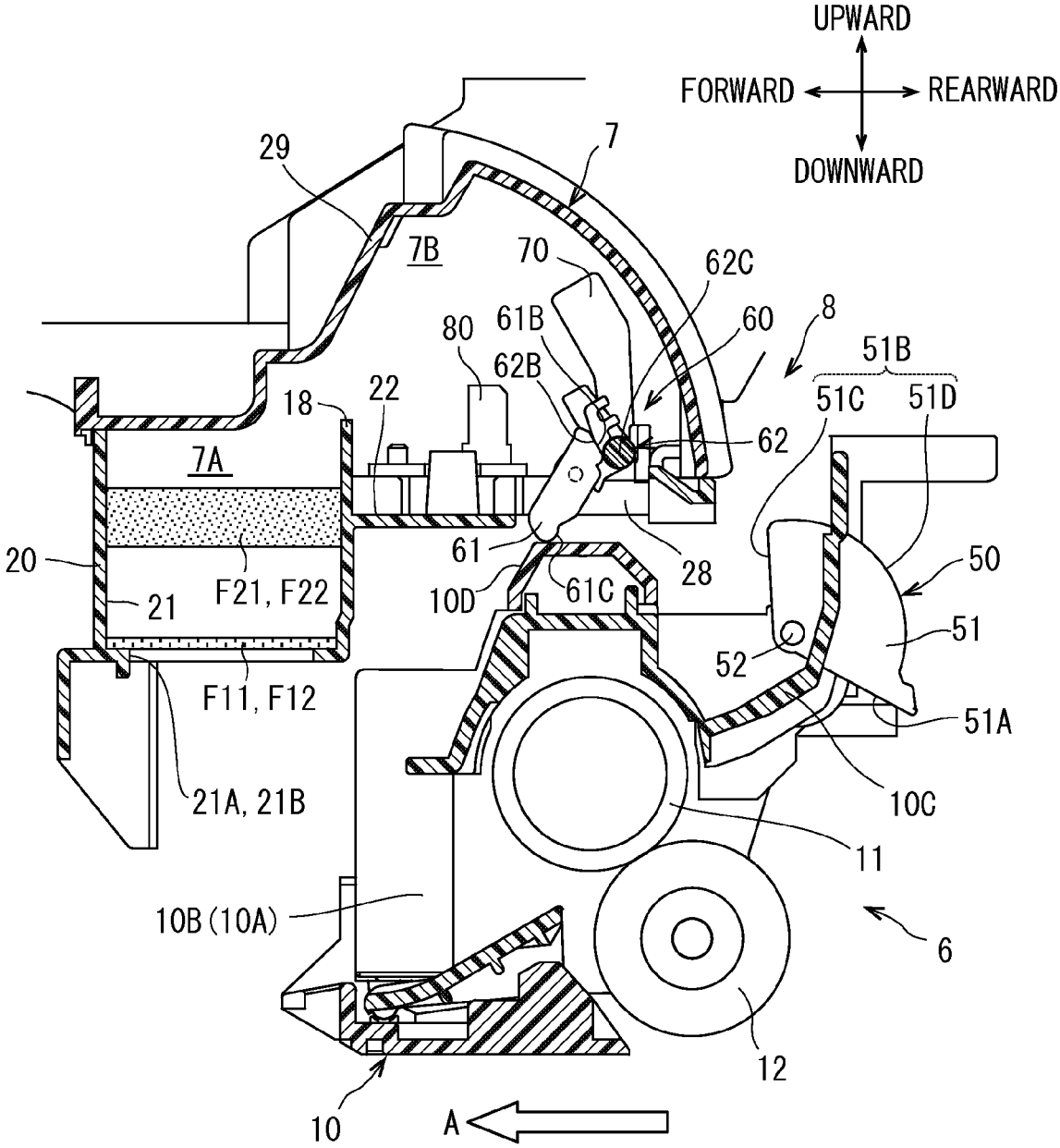
FIG. 11 is related to the image forming device according to the embodiment and an enlarged, cross sectional view showing an essential part and illustrating a motion, in which the fixing unit is mounted to the housing.

Also, as shown in FIG. 11, in case of mounting the fixing unit 6 to the housing 9, the trapezoidal portion 10D abuts against the lower end of the second transmission portion 61 to swing the lower end of the second transmission portion 61 forward. In this case, the rotating shaft 62C swings together with the second transmission portion 61 through the restriction surfaces 61B, 62B. Therefore, the forward end of the interception member 70 connected integrally to the right side of the rotating shaft 62C swings toward the upper wall portion 29. Since an internal space being considerably high in the vertical direction is ensured in the second chamber 7B, however, the interception member 70 will not interfere with the upper wall portion 29. Therefore, with the laser printer 1, a user can mount the fixing unit 6 to the housing 9 without being obstructed by the interception member 70, the rotating shaft 62C, and the second transmission portion 61.

6. Mounting the First Split Body to the Second Split Body

Figure 12:
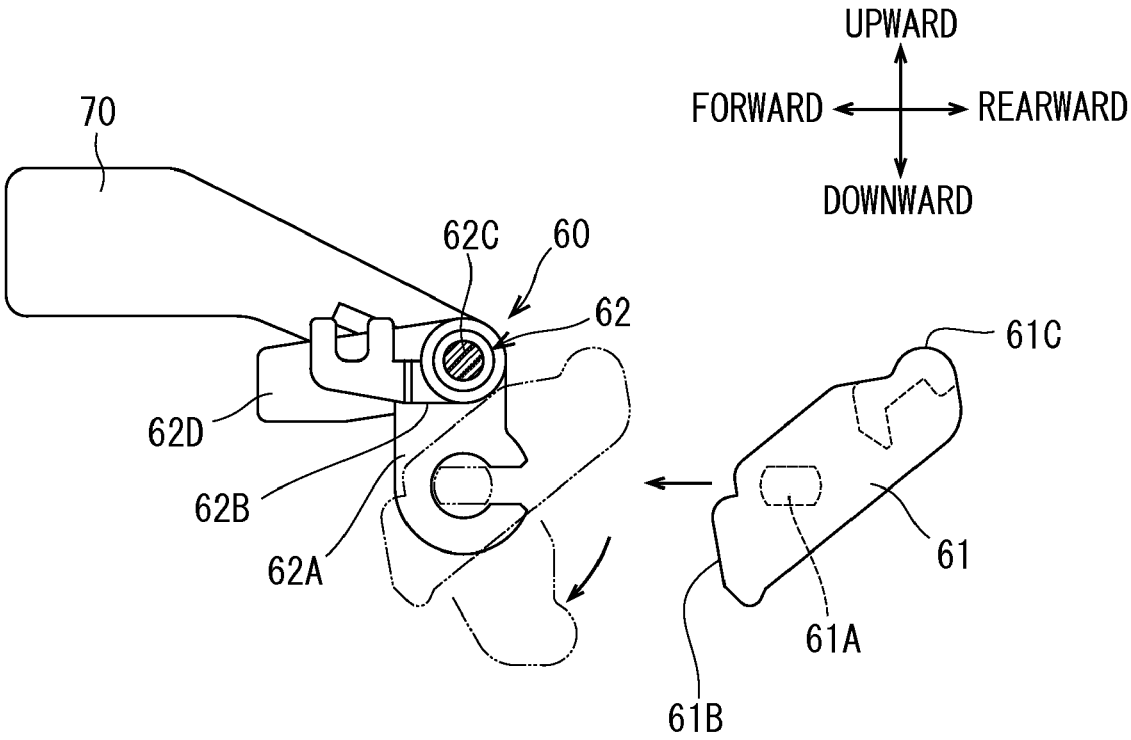
FIG. 12 is related to the image forming device according to the embodiment and a view illustrating a motion, in which a second split body is assembled to a first split body.

As shown in FIG. 12, the shaft portion 61A of the second transmission portion 61 has a cross section substantially in the form of an ellipse with a part of an outer periphery thereof cut out. Also, a hole of the bearing portion 62A is not closed but a rear portion thereof is cut out to be opened. Therefore, the second transmission portion 61 can be readily supported on the bearing portion 62A by inclining the lower end of the second transmission portion 61 to make the same higher than the upper end thereof to mount the shaft portion 61A into the hole of the bearing portion 62A from the rear and swinging the second transmission portion 61 downward about the shaft portion 61A. Thus with the laser printer 1, simplification of an assembling work is achieved.

7. Function and Effect

The laser printer 1 according to the embodiment comprises the housing 9, the duct 7, through which an air in the housing 9 is caused to flow, the detection portion 51A arranged outside the duct 7 to be displaced depending upon the presence of a recording sheet P, the interception member 70 as an example of an operating portion being displaceable in the duct 7, the detection element 80 arranged in the duct 7 to detect a displacement of the interception member 70, and the connection member 60 as an example of a transmission portion that transmits a displacement of the detection portion 51A to the interception member 70 through an opening 28 formed in the duct 7.

With the laser printer 1 thus constructed, the detection element 80 is exposed to an air flowing in the duct 7, so that it is possible to restrict temperature rise of the detection element 80. Hereupon, temperature rise of the detection element 80 indicates at least one of temperature rise by self-heating of the detection element 80 (for example, the detection element 80 undergoes self-heating owing to an electric current flowing through the light emitting diode 81 and the photodetector 82, which constitute the detection element 80, to be increased in temperature in some cases), and temperature rise caused by heating from outside (for example, heat transfer from high-temperature portions such as the image forming unit 3, the fixing unit 6, etc.). Also, with the laser printer 1, it is possible to inhibit foreign matters such as dust, paper powder, developers, etc. from adhering to the detection element 80, and foreign matters possibly adhering to the detection element 80 are readily removed. Therefore, with the laser printer 1, it is possible to have the detection element 80 surely demonstrating the detecting performance with the result that it is possible to improve the detection accuracy, with which a recording sheet P is detected.

Further, with the laser printer 1, the detection portion 51A, the connection member 60, and the interception member 70 are interposed between a recording sheet P and the detection element 80. The detection portion 51A is arranged outside the duct 7 and the connection member 60 transmits a displacement of the detection portion 51A to the interception member 70 through the opening 28 formed on the duct 7. Therefore, with the laser printer 1, even in the case where it is desirable to arrange the detection element 80 and the duct 7 away from a recording sheet P, and in the case where it is necessary to arrange another constituent element between the both, the detecting performance of the detection element 80 can be surely demonstrated by appropriately determining dimensions and shapes of the detection portion 51A and the connection member 60. In this manner, with the laser printer 1, it is possible to make efficient use of an internal space since the layout design of constituent members can be heightened in freedom.

Accordingly, the laser printer 1 according to the embodiment makes it possible to make efficient use of an internal space while improving that accuracy, with which a recording sheet P is detected.

Also, since the laser printer 1 makes it possible to inhibit foreign matters from adhering to the light emitting diode 81 and the photodetector 82, it is possible to demonstrate the detecting performance of the light emitting diode 81 and the photodetector 82, which are susceptible to a considerable decrease in performance due to attachment of foreign matters.

Further, with the laser printer 1, the duct 7 includes the intake portions 21A, 21B and the exhaust portion 22A. Therefore, an air flowing in the duct 7 flows toward the exhaust section from the intake portions 21A, 21B in one direction. Therefore, even when foreign matters are not completely filtered and enter into the duct 7, they are hard to accumulate in the duct 7. Therefore, the laser printer 1 makes it possible to surely inhibit foreign matters from adhering to the detection element 80.

Also, with the laser printer 1, the duct 7 includes the first chamber 7A, in which the intake portions 21A, 21B are positioned, and the second chamber 7B, in which the detection element 80 and the interception member 70 are positioned. With the laser printer 1, since the partition 18 as an example of a preventive member for partitioning of the first chamber 7A and the second chamber 7B surely prevents foreign matters from moving to the second chamber 7B, in which the detection element 80 and the interception member 70 are positioned, it is possible to further surely inhibit foreign matters from adhering to the detection element 80.

Further, with the laser printer 1, the intake portions 21A, 21B are provided on the first inner peripheral surface 21 of the duct 7 and the opening 28 is provided on the second inner peripheral surface 22 positioned inwardly of the duct 7 relative to the first inner peripheral surface 21. Therefore, since the laser printer 1 makes it possible to surely inhibit foreign matters from moving to the opening 28 on the second inner peripheral surface 22 from the intake portions 21A, 21B on the first inner peripheral surface 21, it is possible to inhibit foreign matters from leaking outside the duct 7 from the opening 28. In particular, with the laser printer 1, the first inner peripheral surface 21 and the second inner peripheral surface 22 define the bottom surface of the duct 7 and the second inner peripheral surface 22 is positioned vertically upwardly of the first inner peripheral surface 21. Therefore, the laser printer 1 makes it possible to surely inhibit foreign matters, which are liable to undergo vertically downward precipitation/deposition, from moving to the opening 28, which is positioned upward in the vertical direction, from the intake portions 21A, 21B.

Also, with the laser printer 1, since the ventilation fan 19 forcedly draws an air from the intake portions 21A, 21B to discharge the same from the exhaust portion 22A, the detection element 80 is liable to exposure to an air flowing in the duct 7 as compared with the case of natural exhaust, so that the laser printer 1 can further surely produce the function and effect of the invention.

Further, with the laser printer 1, the opening 28 and the intake portions 21A, 21B, respectively, are provided fore and aft in a longitudinal direction, which agrees with a direction perpendicular to the air guiding direction C. Therefore, the laser printer 1 makes it possible to inhibit foreign matters from moving to the opening 28 from the intake portions 21A, 21B and to surely inhibit foreign matters from leaking outside the duct 7 from the opening 28.

Also, with the laser printer 1, the detection element is arranged upstream of the opening 28 in the air guiding direction C. Therefore, even when an air containing foreign matters flows into the duct 7 through the opening 28 from outside the duct 7, the detection element 80 is hard to be exposed to the air containing foreign matters.

Further, with the laser printer 1, the detection element is arranged upstream of the intake portions 21A, 21B in the air guiding direction C. Therefore, the detection element is hard to be exposed to an air containing those foreign matters, which are drawn into the duct 7 from the intake portions 21A, 21B.

Also, with the laser printer 1, the detection element 80 is arranged in a position on an opposite side to a position, in which the exhaust portion 22A is arranged, with a position, in which the opening 28 is arranged, as a reference. Therefore, even when an air containing foreign matters enters into the duct 7 through the opening 28 to be discharged outside from the exhaust portion 22A, the detection element 80 is hard to be exposed to the air containing foreign matters.

Further, with the laser printer 1, since the rotating shaft 62C, which constitute the connection member 60, extends in parallel to the air guiding direction C, a direction, in which the interception member 70 swings, is one perpendicular to the air guiding direction C. Therefore, it is possible to prevent a disadvantage that the interception member 70 is caused by wind pressure of an air in the duct 7 to swing to lead to an erroneous detection by the detection element 80. Also, as compared with the case where the rotating shaft 62C is supported rotatably outside the duct 7, it is hard to cause a disadvantage that when a peripheral mechanism is to be mounted or dismounted, the peripheral mechanism contacts the rotating shaft to break the same.

Also, with the laser printer 1, the fixing unit 6 is provided detachably on the housing 9. The connection member includes the first transmission portion 51B supported on the fixing unit 6 to be able to swing, and the second transmission portion 61 supported on the duct 7 to be able to swing. Therefore, since the laser printer 1 makes it possible to separate the first transmission portion 51B and the second transmission portion 61 from each other when the fixing unit 6 is to be removed from within the housing 9, the connection member 60 does not obstruct removal of the fixing unit 6.

Further, with the laser printer 1, the first split body and the second split portion (second transmission body) are connected to each other to constitute the connection member 60 as a transmission portion. Provided between the connection member 60 and the fixing unit 6 is the trapezoidal portion 10D as an example of moving means that changes mutual positions of the first split body 62 and the second transmission portion 61 when the fixing unit 6 is to be moved.

With the laser printer 1, the trapezoidal portion 10D changes mutual positions of the first split body 62 and the second split portion (second transmission body) 61 when the fixing unit 6 is to be moved, whereby movement of the fixing unit 6 is not obstructed. In this manner, since the connection member 60 is constructed so that the two split bodies 61, 62 are connected to each other, it is possible to decrease a space required for movement (displacement) of the connection member when the fixing unit 6 is to be moved.

Accordingly, the laser printer 1 makes it possible to make efficient use of an internal space with the result that it is possible to realize miniaturization of the apparatus.

Also, with the laser printer 1, since the first split body 62 and the second split portion (second transmission body) are returned to original positions in a state, in which the fixing unit 6 is mounted to the housing 9, it is possible to transmit a displacement of the detection portion 51A to the interception member 70 without any problem, so that it is possible to demonstrate the detecting performance of the sensor 8. Further, with the laser printer 1, the connection member 60 with the two split bodies 61, 62 connected to each other makes it possible to surely decrease an area, which the sensor 8 occupies in the housing 9.

Also, with the laser printer 1, the second split portion (second transmission body) 61 is supported to be able to swing relative to the first split body 62 about the first axis X1 perpendicular to the mount direction A and the dismount direction B of the fixing unit 6 and the conveyance direction of a recording sheet P. Therefore, with the laser printer 1, a simple and inexpensive construction can ensure not to obstruct movement of the fixing unit 6.

Further, with the laser printer 1, the fixing unit 6 is provided detachably on the housing 9. The first split body and the second split portion (second transmission body) are constructed so that when the fixing unit 6 is to be mounted to the housing 9, the first split body 62 and the second split portion (second transmission body) 61 integrally swing in the mount direction A of the fixing unit 6, and when the fixing unit 6 is to be dismounted from the housing 9, the second split portion (second transmission body) 61 swings in the dismount direction B of the fixing unit 6 independently of the first split body 62. Therefore, with the laser printer 1, a further simple construction can ensure not to obstruct mounting and dismounting of the fixing unit 6.

Also, with the laser printer 1, the first transmission portion 51B is supported to be able to swing about the second axis X2 in parallel to the first axis X1 and includes the abutment surface 51C extending vertically in a state, in which the fixing unit 6 is mounted to the housing 9. The second split portion (second transmission body) 61 includes the guided surface 61C that abuts against the abutment surface 51C to begin to swing. Therefore, with the laser printer 1, even when an installation error is generated in mounting the fixing unit 6 to the housing 9, the first transmission portion 51B can surely transmit a displacement of the detection portion 51A to the first split body 62 and the second split portion (second transmission body) 61. Therefore, with the laser printer 1, the sensor 8 is hard to be adversely influenced by an installation error of the fixing unit 6 and so it is possible to surely demonstrate the detecting performance of the sensor 8.

Further, with the laser printer 1, the first transmission portion 51B includes the guiding surface 51D that is contiguous to the abutment surface 51C to extend from the second axis X2 with the same radius, and the guided surface 61C abuts against the abutment surface 51C to maintain swinging of the second split portion (second transmission body) 61. Therefore, the laser printer 1 makes it possible to prevent excessive swinging of the second split portion (second transmission body) 61, thus enabling preventing abnormal noise and collision.

Also, with the laser printer 1, the first split body 62 includes the rotating shaft 62C joined to the interception member 70 and provided rotatably in the duct 7 on a side toward the housing 9. Therefore, with the laser printer 1, the layout design can be heightened in freedom by appropriately changing the length and arrangement of the rotating shaft 62C, so that it is possible to make further efficient use of an internal space.

Further, with the laser printer 1, the rotating shaft 62C includes the stopper 62D that restricts one end side of that range, in which the interception member 70 is displaced, the stopper 62D being arranged in a region closer to the interception member 70 than to the bearing portion 22F, by which the rotating shaft 62C is supported rotatably in the duct 7. Therefore, the laser printer 1 restricts influences of twist of the rotating shaft 62C to enable the relative, positional relationship between the interception member 70 and the detection element 80 to be maintained proper.

While the invention has been described with respect to the embodiment, the invention is not limited to the embodiment but it goes without saying that the invention can be appropriately changed within a range not departing from a scope thereof to be applied.

Figure 13:
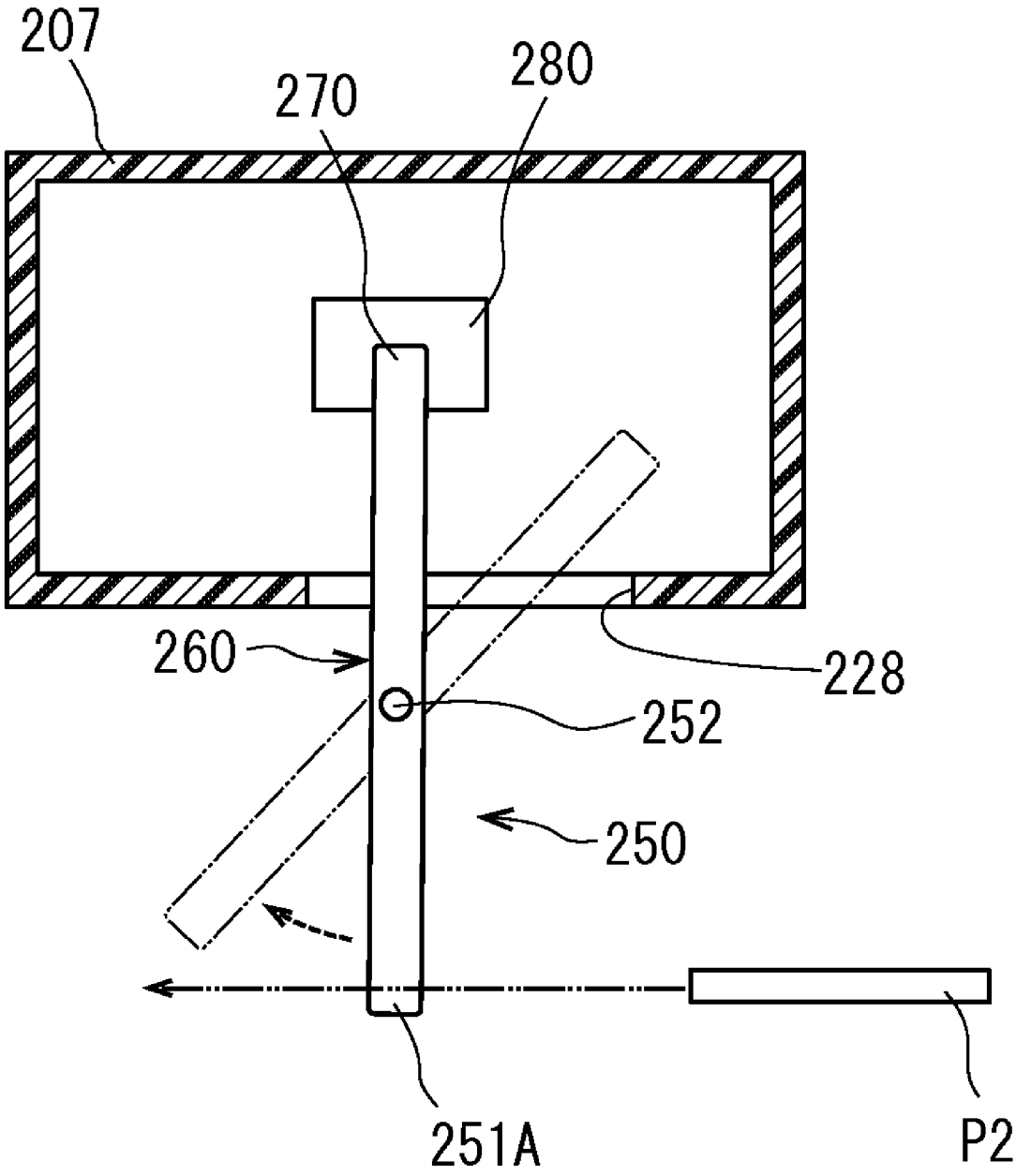
FIG. 13 is related to an image forming device according of a modification and a view illustrating an outline construction of a detection portion, a transmission portion, an operating portion, a detection element, and a duct (opening).

For example, while the detection portion, the transmission portion, and the operating portion in the embodiment are constituted by the sector-shaped swinging member 50, in which the detection portion 51A and the first transmission portion 51B are made integral, the second transmission portion 61, and the connection member 60 made integral with the interception member 70, the invention is not limited to such constitution. FIG. 13 shows a modification.

With the modification of FIG. 13, a single rod-shaped body 250 is provided on a lower side of a duct 207. A center of the rod-shaped body 250 is supported to be able to swing about a shaft portion 252. A lower end of the rod-shaped body 250 is arranged to block a movement path of a detected body P2 moving horizontally below the duct 207. An upper end of the rod-shaped body 250 is arranged to be inserted into an opening 228 formed on an underside of the duct 207. When the lower end of the rod-shaped body 250 abuts against the detected body P2 to be displaced, the rod-shaped body 250 swings about the shaft portion 252, so that the upper end side of the rod-shaped body 250 is displaced in the duct 207. A detection element 280 is arranged in the duct 207 to detect a displacement of the upper end side of the rod-shaped body 250.

In the modification, the lower end side of the rod-shaped body 250 constitutes a detection portion 251A, the upper end side of the rod-shaped body 250 constitutes an operating portion 270, and a portion connecting the lower end side and the upper end side of the rod-shaped body 250 constitutes a transmission portion 260. In this manner, the function and effect described above can also be produced by the detection portion 251A, the transmission portion 260, and the operating portion 270, which are constructed by a single member.

It does not matter how a duct is structured as far as an air in a housing is permitted to flow. For example, a duct may be provided in a housing or may be provided outside a housing. Specific examples of a duct include an arrangement, in which an air is sucked into a duct from within a housing and discharged outside the housing, an arrangement, in which an air is sucked into a duct from outside a housing and discharged to a particular region in the housing, an arrangement, in which an air is sucked into a duct from a particular region in a housing and discharged to a further particular region in the housing, or the like. Also, a direction, in which an air is guided within a duct, may be limited to one direction at all times, or may be switched to a reverse direction.

Specific examples of a detected body include a lid and a door of a housing, a paper feed tray provided detachably on a housing, a toner cartridge, a fixing unit, a guide member that swings to switch a conveyance direction of a recording sheet, etc. in addition to a recording sheet such as sheets, OHP sheets, or the like.

It does not matter how an operating portion is constructed as far as it can be displaced in a duct. For example, an operating portion may be constructed to be arranged outside a duct at the time of product shipment and to enter into the duct through an opening when a detected body is to be detected.

A detection element for detection of a displacement of an operating portion serves for, for example, optical, electrical, and electromagnetic detection. In particular, a detection element for detection of approach of and presence of a detected body in a non-contact manner is generally called "proximity switch", and induction type, electrostatic capacity type, ultrasonic type, photoelectric type, and magnetic type ones are existent. In image forming devices, "photo-interrupter" being a kind of photoelectric type proximity switch is frequently adopted since it is small in size, low in cost, and high in reliability. A photo-interrupter comprises a light emitting diode and a photodetector arranged in opposition to the light emitting diode to receive light irradiated from the light emitting diode, and detects the displacement and the presence of a material body depending upon whether receiving of light by the photodetector is intercepted.

It does not matter how a transmission portion is constructed as far as it transmits a displacement of a detection portion to an operating portion. For example, a transmission portion may be formed integral with a detection portion and an operating portion, or may be combined with a detection portion and an operating portion, which are formed separately therefrom, to be constructed integral therewith. Further, a transmission portion may be formed integral with one of a detection portion and an operating portion, which are formed separately therefrom. Also, a transmission portion may comprise a linkage that connects a detection portion and an operating portion, which are formed separately therefrom, together by means of a single or plural, separate members.

The invention is made use of for an image forming device.

The invention claimed is:

1. An image forming device comprising:

housing:

a duct, through which air in the housing is caused to flow;

a detection portion arranged outside the duct to be displaced according to the presence of, or movement of a detected body;

an operating portion that can be displaced in the duct;

a detection element arranged in the duct to detect displacement of the operating portion; and a transmission portion that transmits displacement of the detection portion to the operating portion through an opening formed on the duct, wherein the duct includes an intake portion, through which air is sucked, an exhaust portion, through which air is discharged, a first chamber, in which the intake portion is positioned, a second chamber, in which the detection element and the operating portion are positioned, and a prevention member that prevents foreign matters from moving to the second chamber from the first chamber while permitting ventilation of the first chamber and the second chamber.

2. The image forming device according to claim 1, wherein the transmission portion comprises a connection member inserted through the opening to connect the detection portion and the operating portion.

3. The image forming device according to claim 1, wherein the detection element comprises a light emitting diode and a photoreceptor.

4. The image forming device according to claim 3, wherein the operating portion comprises an interception member provided in the duct to be able to swing in order to transmits therethrough or intercepts light irradiated to the photoreceptor from the light emitting diode.

5. The image forming device according to claim 1, wherein the prevention member comprises a partition that partitions the first chamber and the second chamber.

6. The image forming device according to claim 1, wherein the duct includes a first inner peripheral surface including a bottom surface of the first chamber and a second inner peripheral surface including a bottom surface of the second chamber, wherein the intake portion is provided on the first inner peripheral surface, and wherein the opening is provided on the second inner peripheral surface.

7. The image forming device according to claim 6, wherein the intake portion is provided on the bottom surface of the first chamber, wherein the opening is provided on the bottom surface of the second chamber, and wherein the bottom surface of the second chamber is positioned vertically upwardly of the bottom surface of the first chamber.

8. The image forming device according to claim 1, further comprising a ventilation fan that draws air from the intake portion and discharges the air from the exhaust portion.

9. The image forming device according to claim 1 wherein the opening and the intake portion, respectively, are provided on one side and on the other side in a direction perpendicular to an air guiding direction, in which air flows along the second chamber.

10. The image forming device according to claim 1, wherein the detection element is arranged upstream of the opening in an air guiding direction, in which air flows along the second chamber.

11. The image forming device according claim 1, wherein the detection element is arranged upstream of the intake portion in an air guiding direction, in which air flows along the second chamber.

12. The image forming device according to claim 1, wherein the detection element and the exhaust portion are arranged opposite to each other with respect to the opening in an air guiding direction, in which air flows along the second chamber.

13. The image forming device according to claim 1, wherein the detected body comprises a recording sheet conveyed in the housing, and the detection portion is provided in the housing to swing in contact with the recording sheet when the recording sheet is conveyed to a predetermined position.

14. An image forming device comprising:

a housing;

a duct, through which air in the housing is caused to flow;

a detection portion arranged outside the duct to be displaced according to the presence of, or movement of a detected body;

an operating portion that can be displaced in the duct;

a detection element arranged in the duct to detect displacement of the operating portion; and a transmission portion that transmits displacement of the detection portion to the operating portion through an opening formed on the duct, wherein the transmission portion includes a rotating shaft connected to the operating portion and provided rotatably in the duct, and wherein the rotating shaft extends toward a downstream side from an upstream side in an air guiding direction, in which air flows along the duct.

15. An image forming device comprising:

a housing;

a duct, through which air in the housing is caused to flow;

a detection portion arranged outside the duct to be displaced according to the presence of, or movement of a detected body;

an operating portion that can be displaced in the duct;

a detection element arranged in the duct to detect displacement of the operating portion;

a transmission portion that transmits displacement of the detection portion to the operating portion through an opening formed on the duct, an image forming unit provided in the housing to transfer a developer to a recording sheet; and a fixing unit constructed to be enabled to be mounted to and dismounted from the housing and to heat and press a recording sheet, to which the developer is transferred, to fix the developer to the recording sheet, wherein the transmission portion includes a first transmission portion supported on the fixing unit to be able to swing, and a second transmission portion supported on the duct to be able to swing, wherein the first transmission portion is connected on one end side thereof to the detection portion and able to engage on the other end side thereof with one end of the second transmission portion, and wherein the second transmission portion is connected on the other end side thereof to the operating portion.

16. The image forming device according to claim 15, wherein the transmission portion comprises a plurality of split bodies, and moving means is provided between the transmission portion and the fixing unit to change mutual positions of the respective split bodies when the fixing unit is to be mounted or dismounted.

* * * * *